US011458490B2

(12) United States Patent
McCarthy

(10) Patent No.: US 11,458,490 B2
(45) Date of Patent: Oct. 4, 2022

(54) CUP LINER AND A FITTING FOR A SPRAY GUN

(71) Applicant: Kevin McCarthy, Affton, MO (US)

(72) Inventor: Kevin McCarthy, Affton, MO (US)

( * ) Notice: Subject to any disclaimer, the term of this patent is extended or adjusted under 35 U.S.C. 154(b) by 0 days.

(21) Appl. No.: 16/382,456

(22) Filed: Apr. 12, 2019

(65) Prior Publication Data

US 2019/0314834 A1 Oct. 17, 2019

Related U.S. Application Data

(60) Provisional application No. 62/763,964, filed on Jul. 12, 2015, provisional application No. 62/761,962, filed on Apr. 12, 2018.

(51) Int. Cl.
*B05B 7/04* (2006.01)

(52) U.S. Cl.
CPC ..... *B05B 7/0408* (2013.01)

(58) Field of Classification Search
CPC ..... B05B 7/0408; B05B 11/00412
USPC ..... 239/303–307, 328
See application file for complete search history.

(56) References Cited

U.S. PATENT DOCUMENTS 5,582,350 A * 12/1996 Kosmyna ..... B05B 15/55 239/345
8,453,949 B2 * 6/2013 Kwon ..... B05B 7/2497 239/305

OTHER PUBLICATIONS

3M PPS Paint Preparation System Brochure, Improve Efficiency Reduce Waste, dated Sep. 25, 2012, pp. 4.

* cited by examiner

*Primary Examiner* — Christopher S Kim
(74) *Attorney, Agent, or Firm* — Stinson LLP

(57) ABSTRACT

A cup liner for a cup of a spray gun includes a fluid reservoir portion that defines a reservoir and includes a divider portion dividing the reservoir into two or more compartments. Each compartment contains a fluid to be dispensed by the spray gun and keeps the fluids separated from fluids held by other compartments. In addition, a fitting for a spray gun includes two or more inlet interfaces and an outlet interface. Each inlet interface couples to a fluid source and the outlet couples to the spray gun such that the fitting provides fluid communication between each fluid source and the spray gun. This permits the spray gun to spray a mixture of the fluids.

27 Claims, 10 Drawing Sheets

CUP LINER AND A FITTING FOR A SPRAY GUN

CROSS-REFERENCE TO RELATED APPLICATIONS

This application claims the benefit of U.S. Provisional Application No. 62/763,964, filed Jul. 12, 2018, and U.S. Provisional Application No. 62/761,962, filed Apr. 12, 2018, the entireties of which are hereby incorporated by reference.

FIELD OF DISCLOSURE

The present disclosure generally relates to a spray gun for paint, and more specifically, a cup liner for a cup of the spray gun and a fitting for the spray gun.

BACKGROUND

People who spray paint cars generally pour the paint material into a spray paint cup. A lid covering the spray paint cup holds the paint material in the spray paint cup. The spray paint cup is attached to a spray paint gun and a painter applies the paint material contained within to the cup by using the spray gun. When the painter pulls the trigger on the spray gun, the paint material is fed or drawn into the spray gun from the cup and dispensed by the spray gun. Disposable paint cup liners are frequently used by painters to hold the paint material in the paint cup. Throwing away the paint cup liner allows for easier cleanup by eliminating the need to clean the paint cup. Sometimes, a painter needs to mix separate liquid components to initiate a chemical reaction there-between before the spraying the combination with the spray gun. Generally, the mixing of these paint materials happens before the materials are placed within the cup or in the cup itself. After mixing the separate paint materials, the combined mixture has to be used within a limited time frame, before the mixture starts to harden and become unusable. Moreover, painters generally mix more paint materials than required for a given project in order to ensure they have enough mixture to paint the project. As a result, any portion of the mixture left over after the painting is completed is thrown away as it is not possible to store the mixture for later use due to the hardening.

SUMMARY

In one aspect, a cup liner for a cup of a spray gun, the cup supporting two or more fluids to be dispensed by the spray gun, includes a fluid reservoir portion configured to be received in an interior of the cup. The fluid reservoir portion is configured to contain the two or more fluids. The fluid reservoir portion defines a reservoir configure to hold the two or more fluids. The fluid reservoir portion includes a divider portion disposed in the reservoir. The divider portion has one or more divider walls that divide the reservoir into two or more compartments. Each compartment is configured to contain one of the two or more fluids. The one or more divider walls separates each compartment such that each compartment is configured to separate the fluid contain therein from the fluids contained in the other compartments when the reservoir is filled with the two or more fluids. The fluid reservoir portion is configured to be fluidly connected to the spray guy when the fluid reservoir portion is received in the cup such that the spray gun can draw at least a portion of each fluid from each of the two or more compartments to spray a mixture of the two or more fluids.

In another aspect, a fitting for a spray gun to connect the spray gun to two or more fluid sources, each fluid source having a fluid to be dispensed by the spray gun, includes two or more inlet interfaces. Each inlet interface defines an inlet to the fitting. Each inlet interface is configured to be coupled to a respective one of the two or more fluid sources such that the fluid of each fluid source is in fluid communication with the inlet defined by the respective inlet interface. The fitting also includes an outlet interface defining an outlet in fluid communication with each inlet. The outlet interface is configured to be coupled to the spray gun. The outlet interface is configured to provide fluid communication between the spray gun and the two or more fluid sources when the outlet interface is coupled to the spray gun and the two or more inlet interfaces are coupled to the two or more fluid sources such that the spray gun can draw at least a portion of each fluid from each of the two or more fluid sources to spray a mixture of the two or more fluids.

Other objects and features of the present disclosure will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
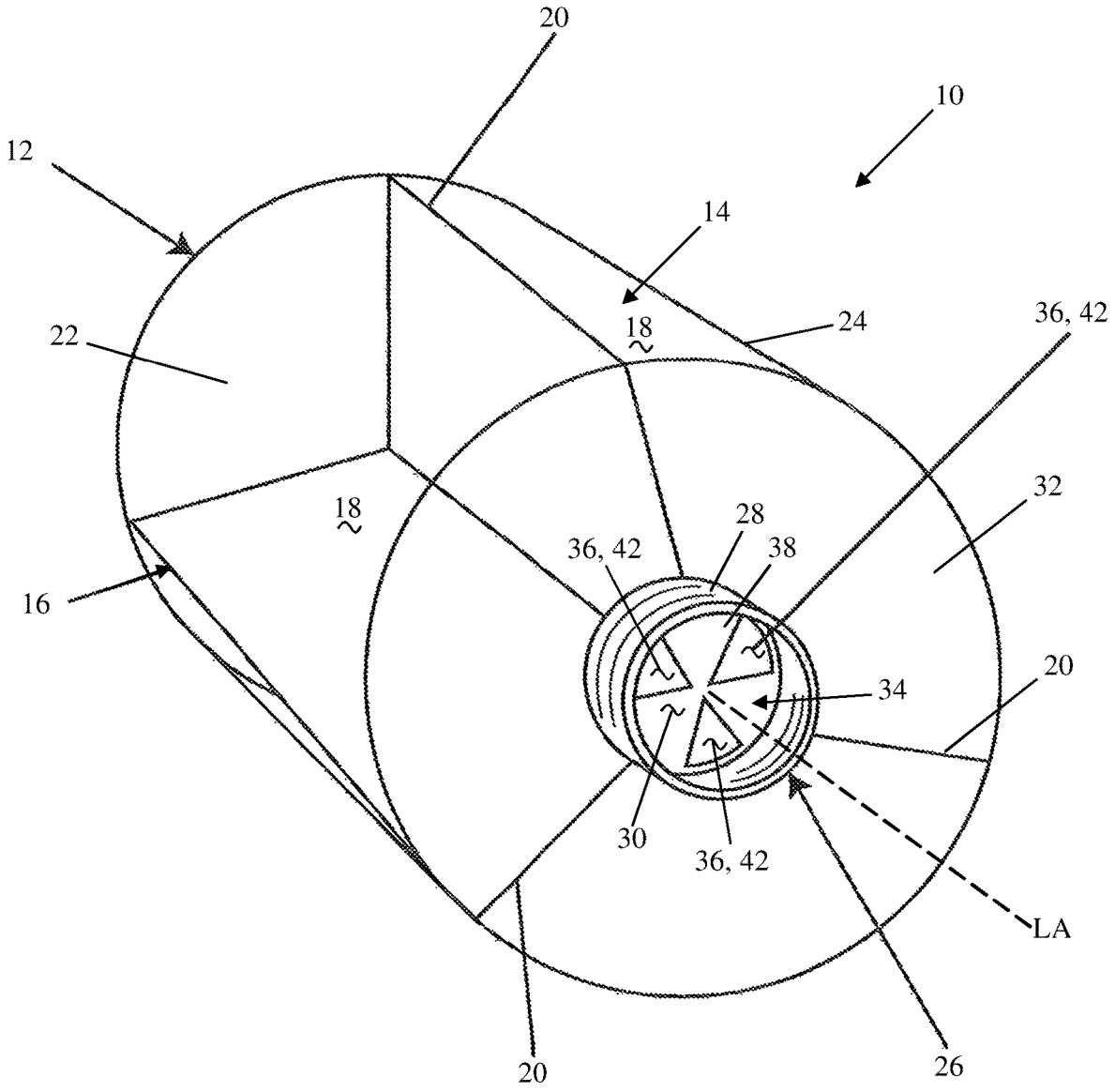
FIG. 1 is a perspective of one embodiment of a cup liner for a cup of a spray gun according to the present disclosure.

Referring to FIGS. 1-4, one embodiment of a cup liner for a cup of a spray gun is generally indicated at reference numeral 10. The cup liner 10 is used to contain or hold two or more paint materials or fluids (not shown) to be dispensed by the spray gun S in the cup (not shown). Generally, the cup supports the two or more fluids that are dispensed by the spray gun S. Specifically, the cup liner 10 holds the two or more fluids in the cup. As will be explained in more detail below, the cup liner 10 separates each of the fluids from one another (e.g., keeps the fluids separate), preventing the fluids from prematurely mixing before being drawn into the spray gun S. Keeping the fluids separate, prevents the initiation of the chemical reaction and the hardening of the resulting fluid mixture, allowing the fluids to be stored and used after the painting by the spray gun S is completed.

Figure 2:
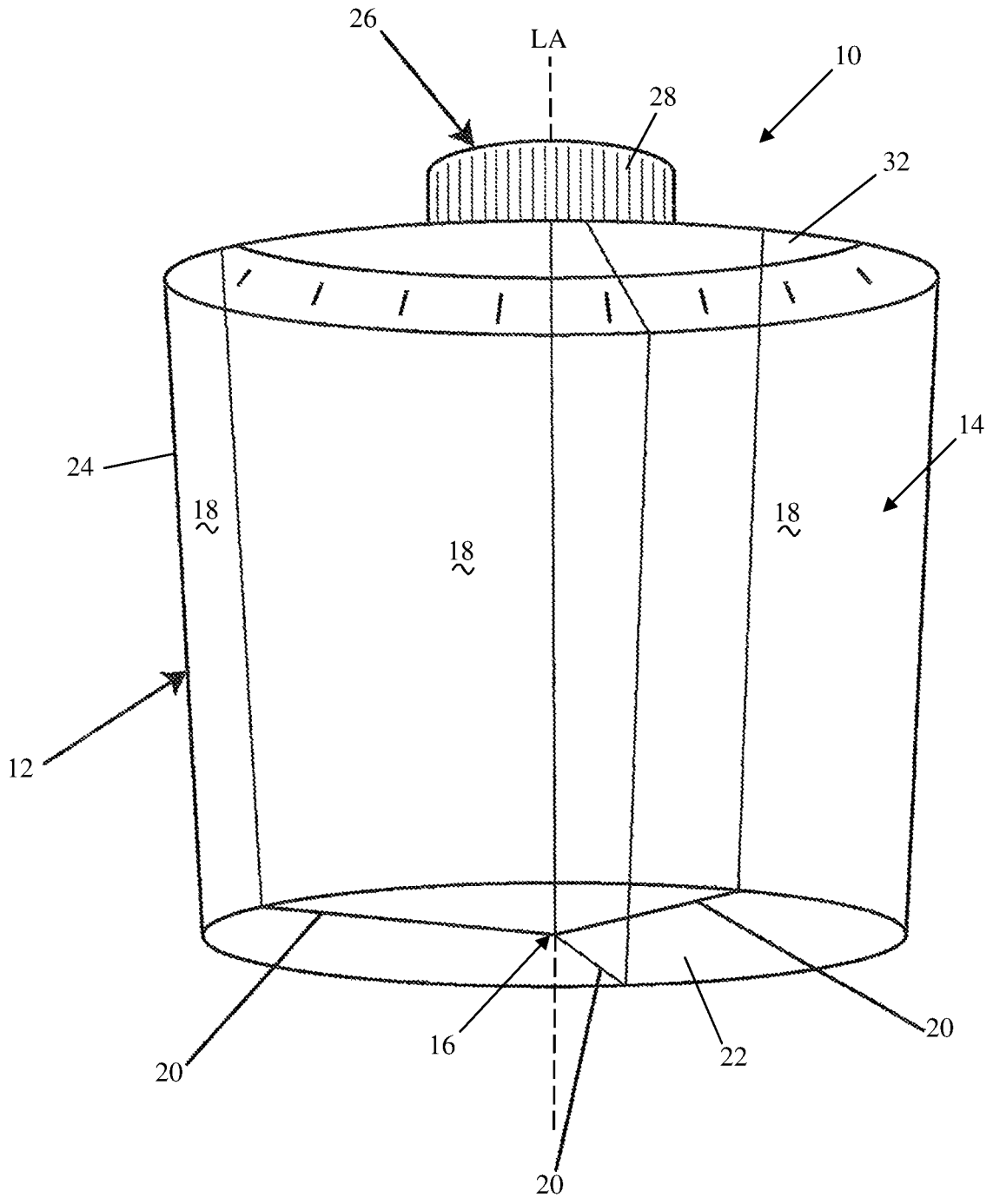
FIG. 2 is a front perspective view thereof.

The cup liner 10 includes a fluid reservoir portion 12 configured to contain the two or more fluids. The fluid reservoir portion 12 defines a reservoir 14 configured to hold the two or more fluids. The fluid reservoir portion 12 is configured to be received in or inserted into an interior of the cup. In particular, the fluid reservoir portion 12 is sized and shaped to substantially conform to the walls of the cup (e.g., correspond to the size and shape of the cup's interior). As shown in FIGS. 1 and 2, the fluid reservoir portion 12 is generally cylindrical. This allows the fluid reservoir portion 12 to conform to the generally cylindrical shape of the cup's interior. The illustrated fluid reservoir portion 12 is also slightly tapered to conform to the slight taper typical in most cups. The fluid reservoir portion 12 includes a lower wall 22 and a cylindrical outer wall 24 extending upward from the lower wall. The lower and outer walls 22, 24 at least partially define the reservoir 14. When the cup liner 10 is received in the cup, the lower wall 22 is generally adjacent to and/or abuts or engages a lower wall of the cup and the outer wall 24 is generally adjacent to and/or abuts or engages an interior wall of the cup that defines the cup's interior. The outer wall 24 has a longitudinal axis LA extending between the upper and lower ends of the fluid reservoir portion 12 (FIG. 2). In the illustrated embodiment, the longitudinal axis LA defined by the outer wall 24 extends through the center of the fluid reservoir portion 12.

The fluid reservoir portion 12 includes a divider portion 16 disposed in the reservoir 14. The divider portion 16 divides the reservoir 14 into two or more compartments 18. The divider portion 16 has one or more divider walls 20 dividing the reservoir 14 into the two or more compartments 18. Each compartment 18 is configured to contain one of the two or more fluids. In the illustrated embodiment, the fluid reservoir portion 12 includes three (broadly, at least two) compartments 18, although more or less compartments are within the scope of the present disclosure. The compartments 18 may all be of generally equal size (e.g., volume) or at least two, including all, of the compartments may be of different or unequal size. For example, the size of the compartments may correspond to the ratio of components used in the spray mixture in one or more embodiments. In the illustrated embodiment, each divider wall 20 is connected to the lower and outer walls 22, 24. Each divider wall 20 extends upward from lower wall 22 toward the upper end of the fluid reservoir portion 12. In one embodiment, an upper edge margin of each divider wall 20 is coplanar with an upper edge margin of the outer wall 24. In another embodiment, the upper edge margin of each divider wall 20 may be disposed either above or below the upper edge margin of the outer wall 24. The illustrated divider portion 16 includes three divider walls 20, although more or less divider walls are within the scope of the present disclosure. The three divider walls 20 each have a lower edge margin connected to the lower wall 22, a first side edge margin connected to the outer wall 24 and an opposite second side edge margin connected to the other divider walls. As shown in FIGS. 1 and 2, the three divider walls 20 are all connected together along the longitudinal axis LA. The three divider walls 20 divide the reservoir 14 into the three compartments 18.

The divider portion 16 separates the compartments 18 from one another to prevent the fluids contained in each compartment from mixing. The one or more divider walls 20 separate each compartment 18 from one another such that each compartment is configured to separate the fluid contained therein from the fluids contained in the other compartments when the reservoir 14 is filled with the two or more fluids. In this manner, the cup liner 10 separates the fluids contained in each compartment 18 from one another to prevent the fluids from mixing. The fluid reservoir portion 12 is configured to be fluidly connected to the spray gun S when the fluid reservoir portion is received in the cup such that the spray gun can draw at least a portion of each fluid from each of the two or more compartments 18 to spray a mixture of the two or more fluids.

In one embodiment, the fluid reservoir portion 12 may include a lip (not shown) connected to the upper edge margin of the outer wall 24 and extending radially outward (e.g., extending in a direction generally perpendicular to the longitudinal axis LA) therefrom. The lip extends circumferentially around the fluid reservoir portion 12 and is configured to engage a rim of the cup when the fluid reservoir portion is received in the interior of the cup. As generally understood in the art, the lip of the fluid reservoir portion 12 is sandwiched between a collar threadably secured to the cup and the rim of the cup to secure the fluid reservoir portion 12 to the cup.

The cup liner 10 may also include an interface 26 coupled to the fluid reservoir portion 12. The interface 26 provides fluid communication between the spray gun S and the reservoir 14 of the fluid reservoir portion 12 such that the spray gun can draw at least a portion of each fluid from each of the two or more compartments 18 to spray (e.g., dispense) a mixture of the two or more fluids. The interface 26 includes a circumferential wall 28 that defines a passageway 30. The passageway 30 defined by the interface 26 is in fluid communication with each of the two or more compartments 18 of the fluid reservoir portion 12. The passageway 30 is configured to be in fluid communication with the spray gun S when the interface 26 is coupled to the spray gun. Thus, the passageway 30 provides fluid communication between the spray gun S and each compartment 18 of the fluid reservoir portion 12 when the interface 26 is coupled to the spray gun. The interface 26 is configured to be coupled to the spray gun S. In one embodiment, the circumferential wall 28 may include interior or exterior threads to threadably connect to the spray gun S. In another embodiment, the circumferential wall 28 may include protrusions and/or detents to connect the interface 26 to the spray gun S. Other ways of connecting the interface 26 to the spray gun S are within the scope of the present disclosure.

In one embodiment, the interface 26 is fixed to the fluid reservoir portion 12. For example, in the illustrated embodiment, the fluid reservoir portion 12 includes an upper wall 32 (that defines a portion of the reservoir 14 and each compartment 18) and the interface 26 is fixed to the upper wall. In this embodiment, the upper wall 32 is connected to the divider walls 20 and the outer wall 24 (at the upper edge margins thereof) and generally closes the upper end of the each compartment 18. In another embodiment, the interface 26 (or a portion thereof) is releasably coupled to the fluid reservoir portion 12. For example, the interface 26 may be releasably coupled to the upper wall 32. In another example, the interface 26 includes the upper wall 32 and the upper wall is releasably coupled to the fluid reservoir portion 12 (broadly, the interface is releasably or removably coupled to the reservoir portion). In any of these embodiments, the interface 26 sealingly engages the fluid reservoir portion 12 to inhibit or prevent the two or more fluids contained in the reservoir from mixing. For example, if the fluid reservoir portion 12 includes the upper wall 32, the interface 26 sealingly engages (e.g., creates a fluid tight seal with) the upper wall to prevent any fluid from moving between the upper wall and interface. Similarly, if the interface 26 includes the upper wall 32, the upper wall sealingly engages the divider portion 16 (e.g., the one or more divider walls 20) and the outer wall 24 to prevent any fluid from moving there-between. In these embodiments, the upper wall 32 may include one or more openings aligned with each compartment 18 and the passageway 30 to fluidly connect each compartment with the passageway.

Figure 3:
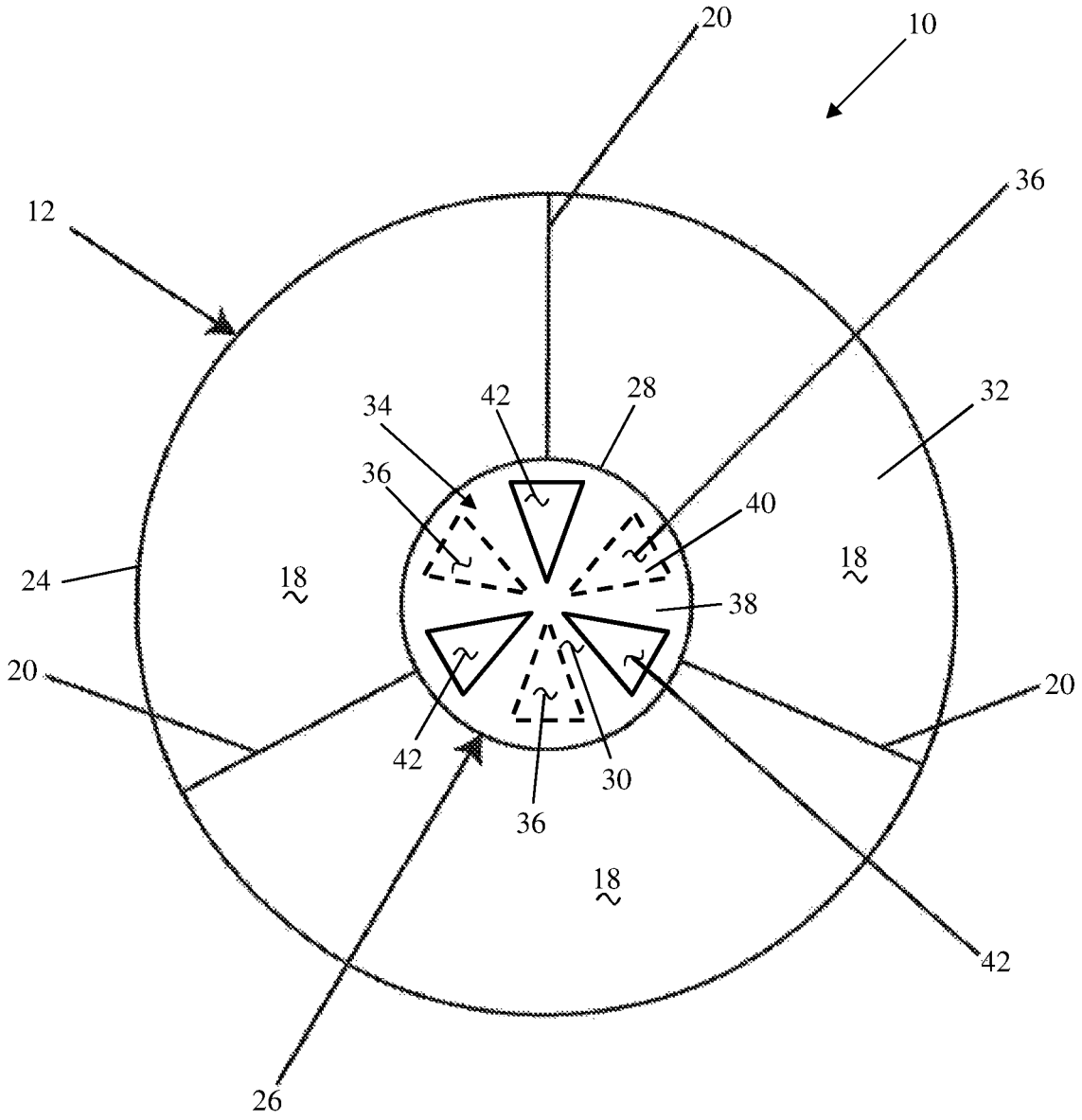
FIG. 3 is a top view thereof.

The interface 26 is configured to selectively close each compartment 18 of the fluid reservoir portion to inhibit the two or more fluids contained in the reservoir 14 from mixing and/or from being drawn into the spray gun S. The interface 26 is also configured to selectively open each compartment 18 of the fluid reservoir portion 12 to permit the spray gun S to draw at least a portion of each fluid from each of the two or more compartments to spray a mixture of the two or more fluids. Preferably, the interface 26 includes one or more valves 34 disposed between the passageway 30 and the two or more compartments 18. In the illustrated embodiment, a single valve 34 is disposed between and connected to each of the compartments 18 and the passageway 30. In other embodiments, the interface 26 may include a dedicated valve to each compartment 18 that can be operated independently of the other valves. The one or more valves 34 have an open configuration (FIG. 1) and a closed configuration (FIG. 3). The one or more valves 34 close the two or more compartments 18 of the fluid reservoir portion 12 (e.g., fluidly disconnect each compartment from the passageway 30 and, therefore, from one another) to inhibit the two or more fluids contained in the reservoir 14 from mixing and/or from being drawn by the spray gun S when the one or more valves are in the closed configuration. The one or more valves 34 open the two or more compartments 18 of the fluid reservoir portion 12 (e.g., fluidly connect each compartment with the passageway 30 and, therefore, with one another) to permit the spray gun S to draw at least a portion of each fluid from each of the two or more compartments to spray a mixture of the two or more fluids when the valve is in the open configuration.

In the illustrated embodiment, the valve 34 is selectively opens and closes the compartments 18 together. Referring to FIG. 3, the illustrated valve 34 includes a stationary plate 38 defining at least one opening 36 aligned with the openings in the top wall 32. Thus, each opening 36 is aligned with at least one of the openings in the top wall 32 for each compartment 18. The valve 34 includes a selectively rotatable plate 40, relative to the stationary plate 38, configured to move between open and closed positions to open and close the valve. The rotatable plate 40 defines openings 42 (broadly, two or more openings). The openings 36 are shown in phantom in FIG. 3. Each opening 42 is configured to align with one of the openings 36 of the stationary plate 38 when the rotatable plate is in the open position (e.g., the valve 34 is in the open configuration) so that the valve is open (FIG. 1) and each opening 42 is configured to be misaligned with all of the openings 36 when the rotatable plate is in the closed position (e.g., the valve is in the closed configuration) so that the valve is closed (FIG. 3). Rotating the rotatable plate 40 relative to the stationary plate 38 selectively opens and closes the valve 34 (e.g., moves the openings 42 into and out of alignment with openings 36). The use of other types and styles of valves are within the scope of the present disclosure. In one embodiment, the interface 26 may include a mesh screen disposed between the compartments 18 and the valve 34 to filter each fluid before the fluids enter the valve. The one or more valves 34 may provide a visual indication if the valve is open or closed. For example, a painter can visually observer whether or not the openings 36, 42 are aligned or indicia may be provided on the valve to indicate if the valve is open or closed.

Figure 4:
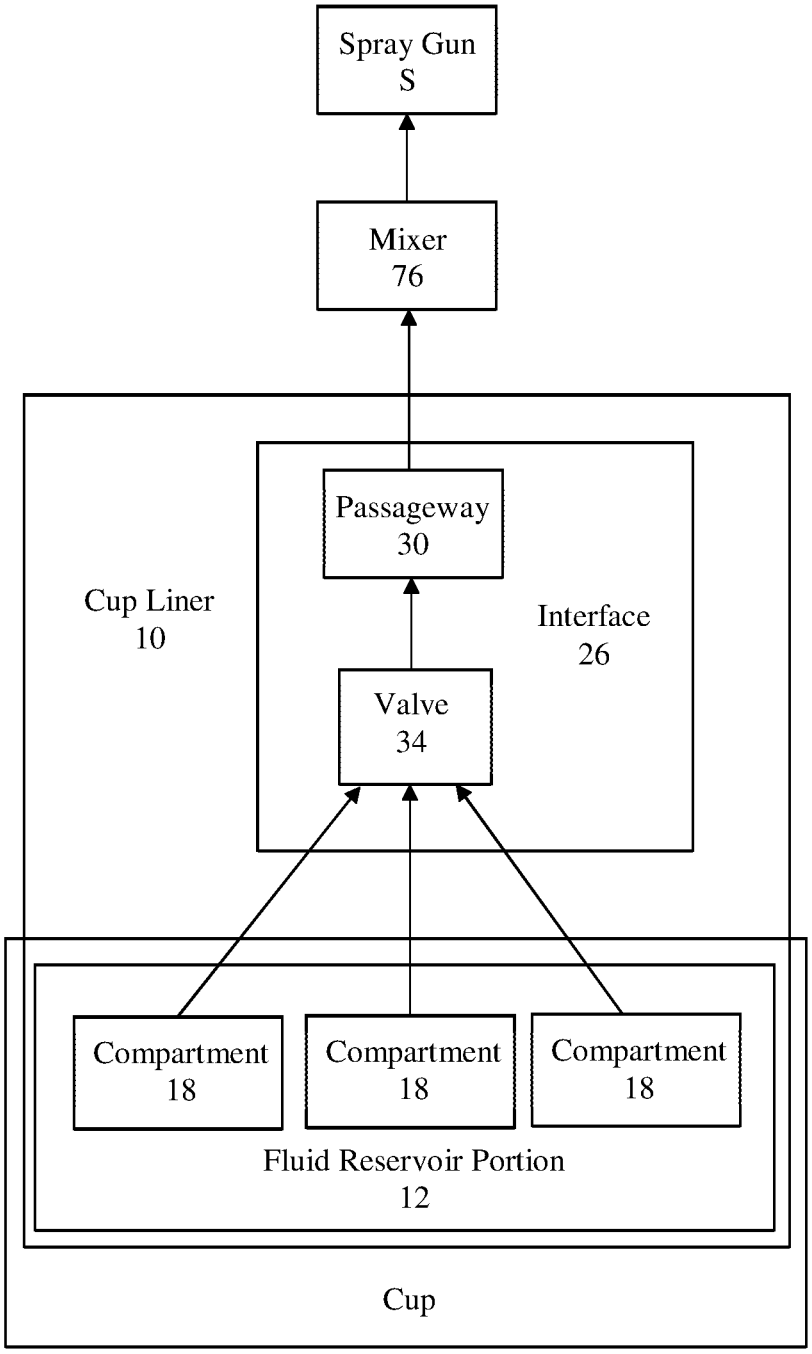
FIG. 4 is an exemplary schematic diagram of the flow of fluids from the cup liner to the spray gun.
Figure 5:
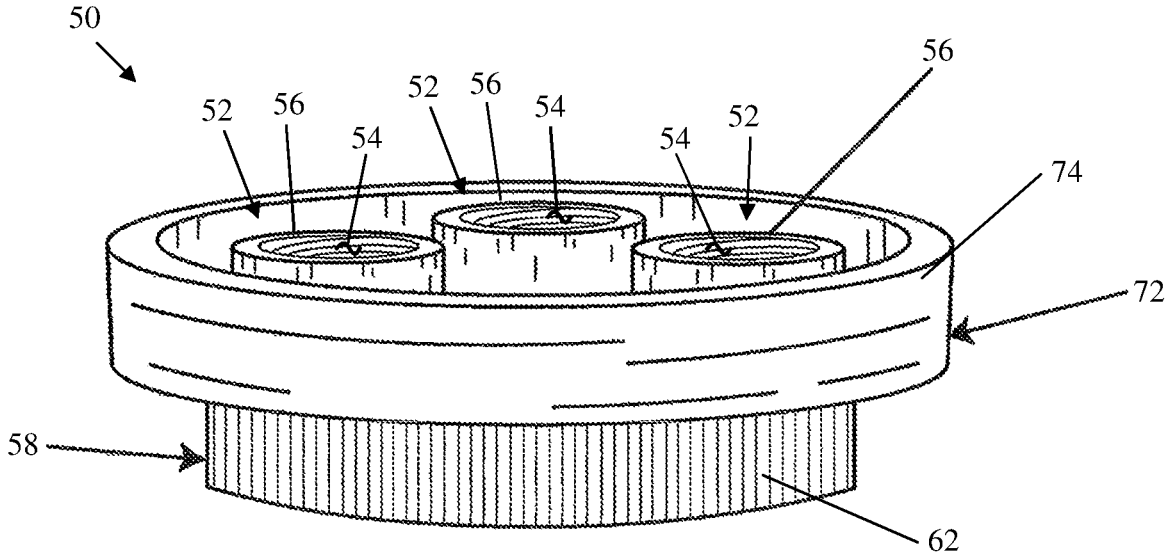
FIG. 5 is a perspective of one embodiment of fitting for a spray gun according to the present disclosure that connects two or more fluid sources to the spray gun.

Referring to FIGS. 1-4, in operation, the fluid contained in each compartment 18 is drawn out of each compartment 18, through the valve 34 and into the passageway 30 before entering the spray gun S (FIG. 4). The fluids mix in the passageway 30 and continue to mix as the fluids (e.g., fluid mixture, fluid combination) move through and out of the spray gun S. In one embodiment, a mixer 76 may be connected to and between the interface 26 and the spray gun S to mix the two or more fluids before the fluids enter the spray gun (FIG. 4). The mixer 76 may be any suitable device configured to mix or agitate a flow of fluid there-through, such as by introducing or creating turbulence in the flow of fluids. For example, the mixer 76 may include one or more protrusions, guides, and/or projections that extend into the flow and/or redirect the flow of the fluids to effectuate mixing. The mixer 76 may be disposable (e.g., configured to be used once and then thrown away). In certain embodiments, the one or more valves 34 act as a proportional metering device, permitting a proportional amount of each fluid (relative to the amounts of the other fluids) to flow out of each compartment 18 in order to achieve the correct mixing ration of the two or more fluids. For example, in the illustrated embodiment, the openings 36 are generally equal in size (e.g., cross-sectional area taken relative to the direction of flow) resulting in generally equal proportions of each fluid flowing into the passageway 30 and into the spray gun S. Openings 36 of generally unequal size would result in unequal proportions of each fluid flowing into the passageway. Accordingly, by controlling the size of the opening the fluid from each compartment 38 flows through, the relative proportions of each fluid dispensed by the spray gun S can be controlled. In this manner, the desired mixing ratio of the two or more fluids can be obtained. In addition, the one or more valves 34 can be partially opened (e.g., partially closed) to control the mixing ratio of the two or more fluids. For example, in an embodiment where each compartment 18 has a dedicated, independently operatable valve 34, the mixing ratio of the two or more fluids can be established by selectively determining the extent each valve is opened. Other ways of metering the fluids form the compartments to the spray gun can also be used in one or more embodiments.

In one embodiment, the lower, outer, divider and upper walls 22, 24, 20, 32 are made of flexible and/or rigid plastic. The plastic may be opaque or transparent. The lower, outer, divider and upper walls 22, 24, 20, 32 are show as being transparent in FIGS. 1-3.

In one embodiment, the cup liner 10 is pre-filled with fluids in each of the compartments 18. In this embodiment, a painter need only select the cup liner with the desired fluids already contained therein. For example, each of the two or more compartments can be pre-filled, by the manufacturer, with one of the two or more fluids (e.g., individual paint components). The exact fluids filling each compartment 18 and the number of compartments will vary based on the paint mixture being used. Accordingly, there may be any number of different pre-filled cup liner 10 options with different ratios, types and numbers of fluids. In this embodiment, the cup liner 10 may include a tamper-evident seal or closure (not shown) to provide a visual indication to the painter if the reservoir, which has been pre-filled with fluid, has been accessed. In one embodiment, a single tamper-evident seal closing all the compartments 18 may be provided. In another embodiment, separate tamper-evident seals may be used for each compartment. Each tamper-evident seal may close the compartment the tamper-evident seal is associated with or otherwise be operatively connected to the component closing each compartment. For example, the tamper-evident seal may close the opening to the compartment 18 or be operatively connected to (e.g., a part of) a component, such as a lid, that closes the opening to the compartment. In either case, the tamper-evident seal is configured to be at least one of deformed and/or removed (e.g., the tamper-evident seal is broken) in order to open the compartment 18. In other words, the compartments 18 cannot be opened (e.g., accessed) without damaging the fluid reservoir portion 12 (e.g., lower wall 22, outer wall 24, upper wall 32, etc.) and/or the tamper-evident seal such that the compartments having been opened is apparent. In this way, a painter can perform a quick visual inspection of the cup liner 10 to check for any damage or signs that one or more of the compartments 18 have been accessed. Once the tamper-evident seal is broken by opening the compartment 18, the compartment can be fluidly connected to the spray gun S, via the interface 26, as described herein.

In another embodiment, the cup liner 10 is empty and the painter fills each compartment 18 of the cup liner with the fluids. For example, the painter can fill each compartment 18 by opening the one or more valves 34 and pouring the fluid into the fluid reservoir portion 12, by removing a releasable interface and then replacing it, etc.

The cup liner 10, as disclosed herein, keeps the two or more fluids separate in each compartment 18. In addition, the cup liner 10 is able to open and close each compartment 18 via the valve 34. By keeping the fluids separate and having a valve 34 that can open and close (e.g., seal off) each compartment 18, the cup liner 10 is able to reduce costs, time and waste. The cost savings is a result of having no substantial fluid waste. Mixing the fluids downstream of the divided cup liner 10 and having the ability to close each compartment 18 allows the fluids contained in the fluid reservoir portion 12 to be stored and used later, as opposed to being thrown away when the painting project is completed.

Referring to FIGS. 5-10, one embodiment of a fitting for a spray gun S is generally indicated at reference numeral 50. The fitting 50 separately connects the spray gun S to two or more fluid sources (not shown), each fluid source having a paint material (paint or coating component) or fluid (not shown) to be dispensed by the spray gun. Generally, the fitting 50 fluidly connects two or more fluid sources to the spray gun S while keeping the fluids separate. Keeping the fluids separate, prevents the initiation of the chemical reaction and the hardening of the resulting fluid mixture, allowing the fluids to be stored and used after the painting by the spray gun S is completed.

The fitting 50 is configured to be coupled to two or more fluid sources. The fitting 50 provides fluid communication between the spray gun S and the two or more fluid sources such that the spray gun can draw at least a portion of each fluid from each of the two or more fluid sources to spray (e.g., dispense) a mixture of the two or more fluids. The fitting 50 includes two or more inlet interfaces 52. Each inlet interface 52 defines an inlet 54 to the fitting 50. Each inlet interface 52 is configured to be coupled to a respective one of the two or more fluid sources such that the fluid of each fluid source is in fluid communication with the inlet defined by the respective inlet interface. In the illustrated embodiment, the fitting 50 includes three (broadly, at least two) inlet interfaces 52, although more or less inlet interfaces 52 are within the scope of the present disclosure. In the illustrated embodiment, each inlet interface 52 includes a generally cylindrical wall 56 that defines at least a portion of the respective inlet 54 of each inlet interface. The cylindrical wall 56 is configured to couple to the fluid source. In the illustrated embodiment, each cylindrical wall 56 includes interior threads to threadably connect to one of the fluid sources. In other embodiments, the cylindrical wall 56 may include exterior threads or protrusions and/or detents to connect to one of the fluid sources. Other ways of connecting the fitting 50 to the fluid sources are within the scope of the present disclosure. Each inlet interface 52 sealingly engages (e.g., creates a fluid tight seal with) the fluid source to prevent any fluid from moving between the inlet interface and the fluid source. The inlets 54 may all be of generally equal size (e.g., cross-sectional area) or at least two, including all, of the inlets may be of different or unequal size. Because each fluid source is connected to its own inlet interface 52, the fluids contained in (e.g., held by, supplied by) each fluid source are kept separate until the fluids are drawn into the spray gun S. In this manner, the fluids from each fluid source are prevented from mixing until the fluids flow into the fitting 50.

The fitting 50 also includes an outlet interface 58 configured to be coupled to the spray gun S. The outlet interface 58 is configured to provide fluid communication between the spray gun S and the two or more fluid sources when the outlet interface is coupled to the spray gun and the two or more inlet interfaces 52 are coupled to the two or more fluid sources. The outlet interface 58 defines a passageway or outlet 60. The outlet 60 is in fluid communication with each of the two or more inlets 54. Internal passaging (not shown) fluidly connects each inlet 54 to the outlet 60. The outlet 60 is configured to be in fluid communication with the spray gun S when the outlet interface 58 is coupled to the spray gun. Thus, the outlet 60 provides fluid communication between the spray gun S and each inlet 54 when the outlet interface 58 is coupled to the spray gun. In one embodiment, the outlet interface 58 includes a circumferential wall 62 that defines at least a portion of the outlet 60. In one embodiment, the circumferential wall 62 may include interior or exterior threads to threadably connect to the spray gun S. In another embodiment, the circumferential wall 62 may include protrusions and/or detents to connect the outlet interface 58 to the spray gun S (e.g., by bayonet connections). Other ways of connecting the fitting 50 to the spray gun S are within the scope of the present disclosure. The outlet interface 58 sealingly engages (e.g., creates a fluid tight seal with) the spray gun S to prevent any fluid from moving between the outlet interface and the spray gun.

Figure 6:
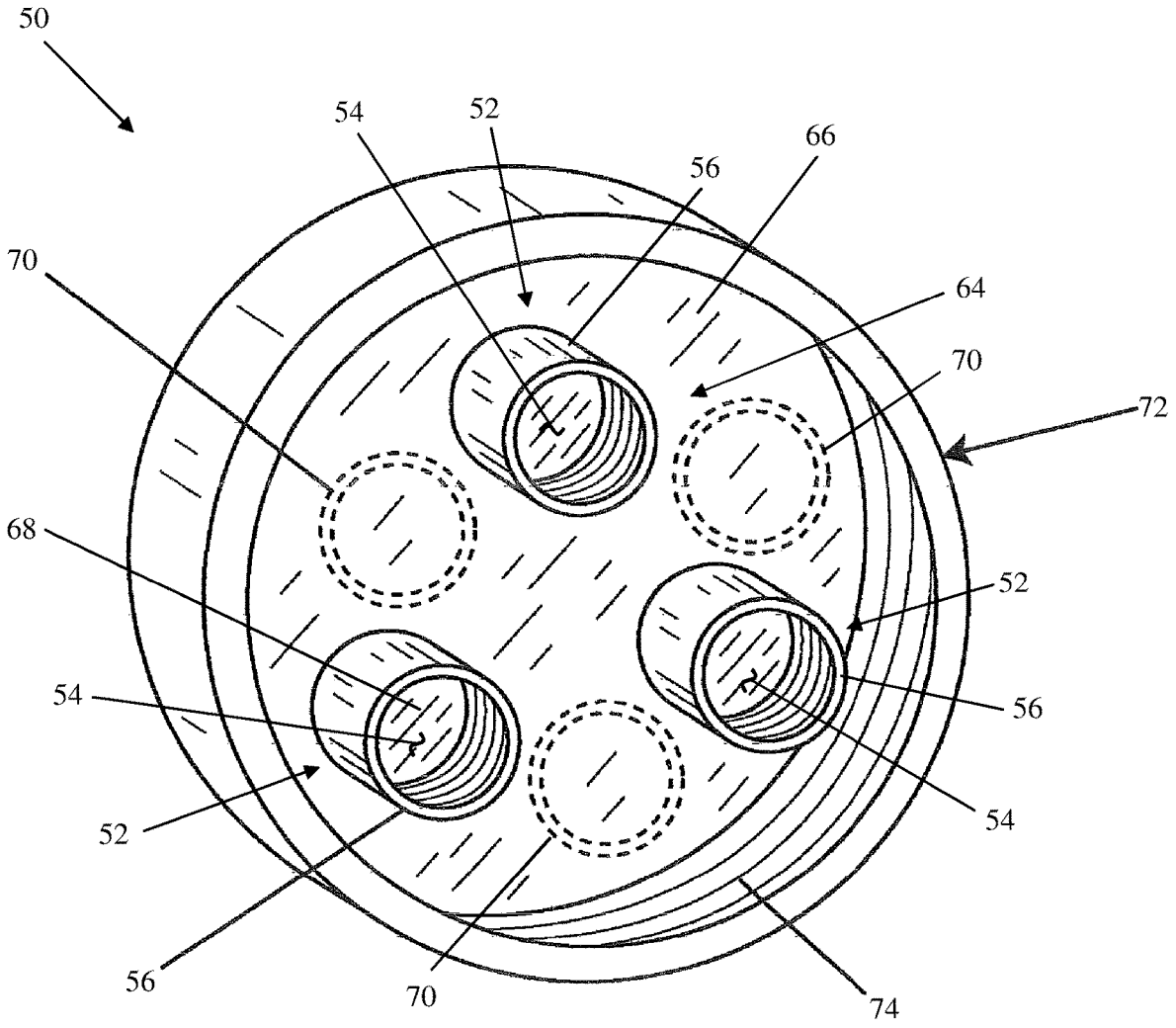
FIG. 6 is a top perspective of the fitting with a valve of the fitting in a closed configuration.
Figure 7:
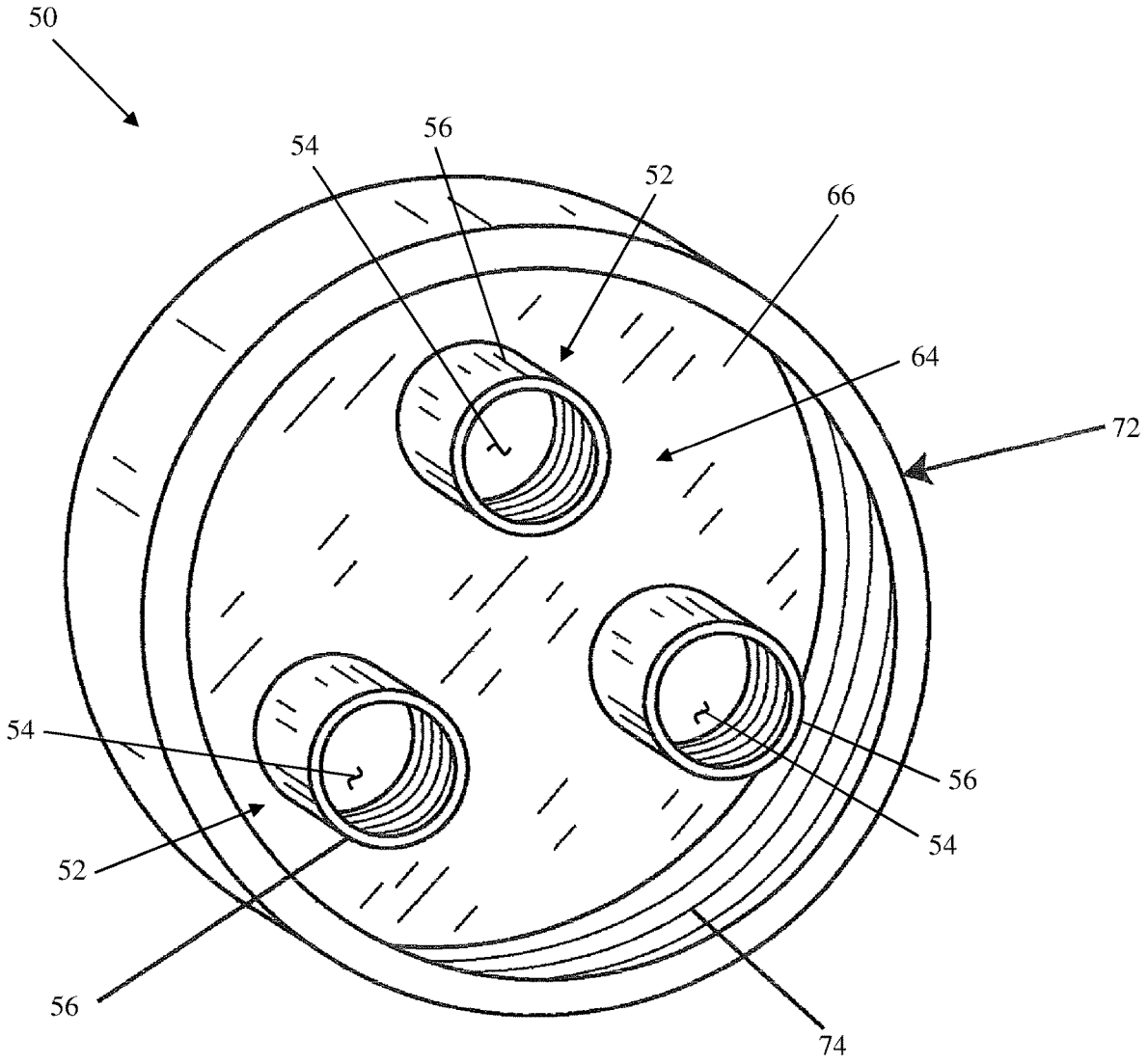
FIG. 7 is similar to FIG. 6, with the valve in an open configuration.
Figure 8:
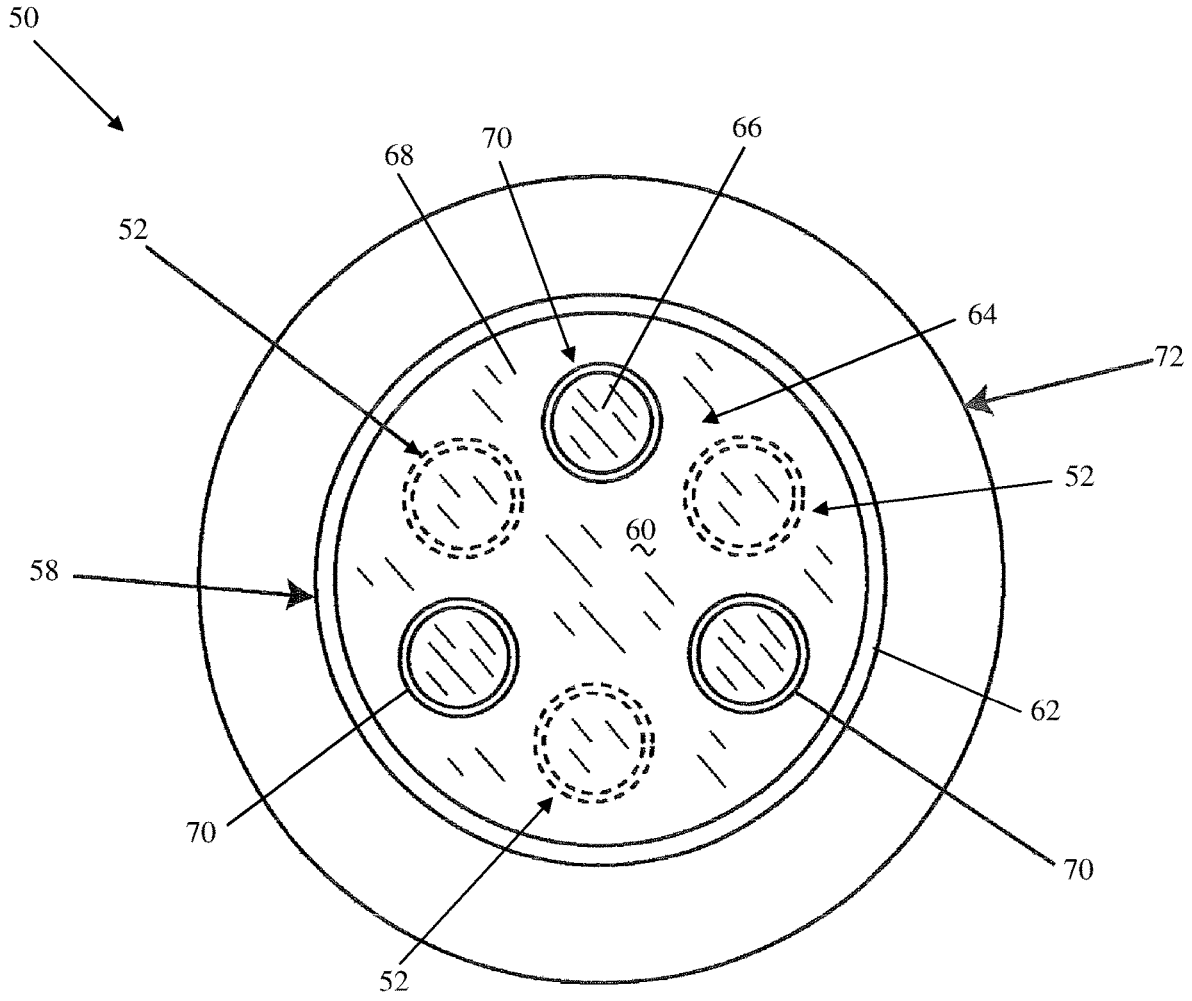
FIG. 8 is bottom view of the fitting with the valve in the closed configuration.
Figure 9:
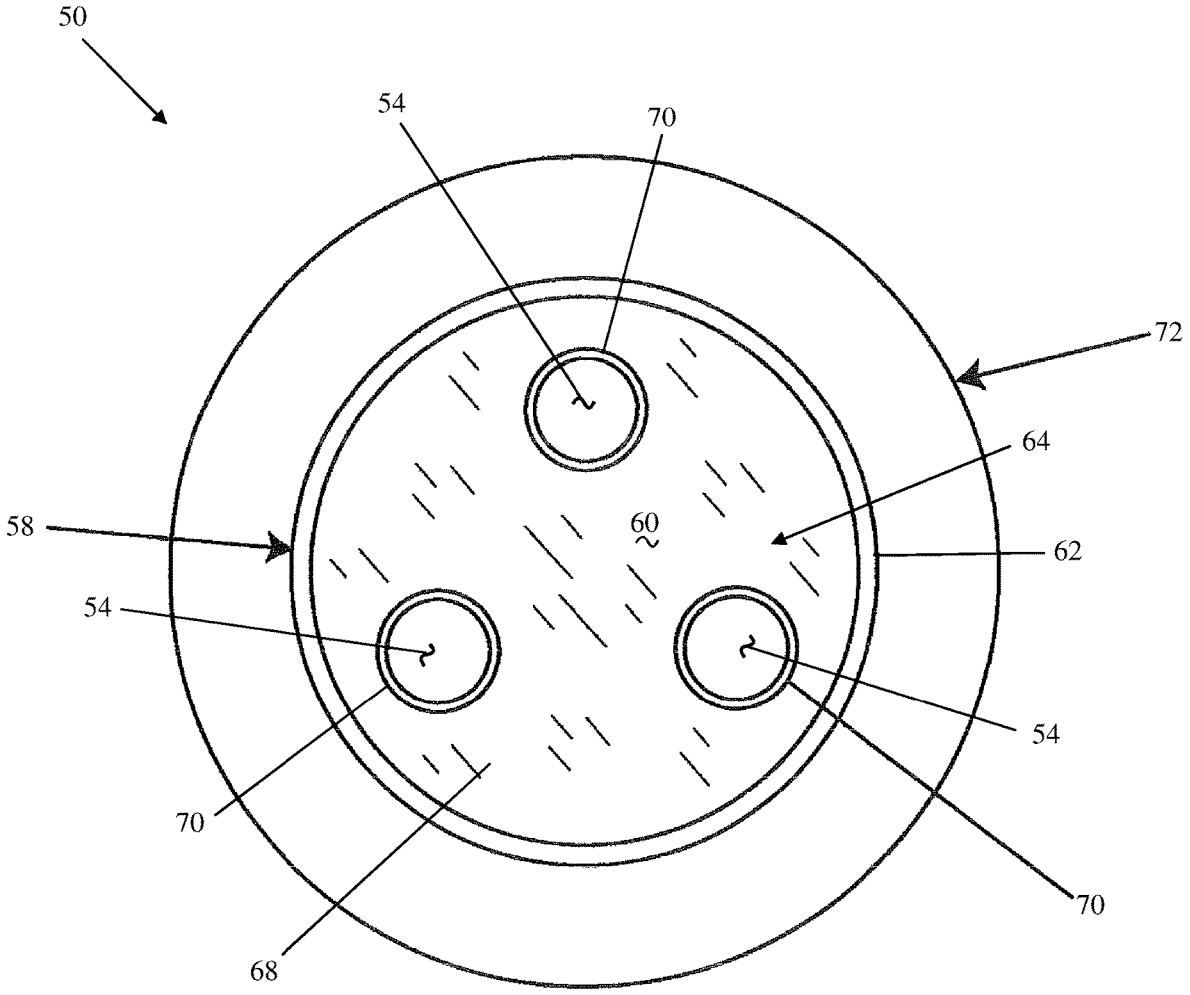
FIG. 9 is similar to FIG. 8, with the valve in the open configuration.

The fitting 50 is configured to selectively close (e.g., fluidly disconnect) each inlet 54 of the inlet interfaces 52 to inhibit the two or more fluids from each of the two or more fluid sources from mixing and/or from being drawn into the spray gun S. The fitting 50 is also configured to selectively open (e.g., fluidly connect) each inlet 54 of the inlet interfaces 52 to permit the spray gun S to draw or receive at least a portion of each fluid from each of the two or more fluid sources to spray a mixture of the two or more fluids. Preferably, the fitting 50 includes one or more valves 64 disposed along the passaging between the outlet 60 and the two or more inlets 54 and fluidly connects the outlet to each inlet. In other words, the one or more valves 64 are disposed between the outlet interface 58 and the two or more inlet interfaces 52. In the illustrated embodiment, a single valve 64 is disposed between and connected to each of the inlets 52 and the outlet 60. In other embodiments, the fitting 50 may include a dedicated valve to each inlet 54 that can be operated independently of the other valves. The one or more valves 64 have an open configuration (FIGS. 7 and 9) and a closed configuration (FIGS. 6 and 8). The one or more valves 64 close the two or more inlets 54 (e.g., fluidly disconnect each inlet from the outlet 60 and, therefore, from one another) to inhibit the two or more fluids contained in the two or more fluid sources from mixing and/or from being drawn by the spray gun S when the one or more valves are in the closed configuration. The one or more valves 64 open the two or more inlets 54 to permit the spray gun S to draw at least a portion of each fluid from each of the two or more fluid sources to spray a mixture of the two or more fluids when the valve is in the open configuration.

In the illustrated embodiment, the valve 64 selectively opens and closes the inlets 54 together. The illustrated valve 64 includes a stationary plate 66 defining at least one opening coextensive or aligned with the inlet 54. The inlet interfaces 52 and inlets 54 are shown in phantom in FIG. 8. In the illustrated embodiment, each circumferential wall 56 extends from the stationary plate 66 from each opening. The valve 64 includes a selectively rotatable plate 68, relative to the stationary plate 66, configured to move between open and closed positions to open and close the valve. In the illustrated embodiment, the circumferential wall 62 extends from the rotatable plate 68 in a direction generally opposite to the circumferential walls 56. The rotatable plate 68 defines openings 70 (broadly, two or more openings). The openings 70 are shown in phantom in FIG. 6. Each opening 70 is configured to align with one of the openings (e.g., inlets 54) of the stationary plate 66 when the rotatable plate 68 is in the open position (e.g., the valve 64 is in the open configuration) so that the valve is open (FIGS. 7 and 9) and each opening 70 is configured to be misaligned with all of the openings (e.g., inlets 54) of the stationary plate when the rotatable plate is in the closed position (e.g., the valve is in the closed configuration) so that the valve is closed (FIGS. 6 and 8). Rotating the rotatable plate 68 relative to the stationary plate 66 selectively opens and closes the valve 64 (e.g., moves the openings 70 into and out of alignment with the inlets 54). The use of other types and styles of valves are within the scope of the present disclosure. In one embodiment, the inlet interfaces 52 may include a mesh screen to filter each fluid before the fluids enter the valve 64. The one or more valves 64 may provide a visual indication if the valve is open or closed. For example, a painter can visually observer whether or not the openings 70 and inlets 54 are aligned or indicia may be provided on the valve to indicate if the valve is open or closed.

In one embodiment, the fitting 50 may include a cup connection portion 72 configured to couple to a cup (not shown) used with a spray gun S, as described herein, in order couple the fitting to the cup. In this manner, the fitting 50 acts as a lid for the cup. In the illustrated embodiment, the cup connection portion 72 includes a circumferential wall 74 that is configured to connect with the cup. The circumferential wall 74 includes interior threads to threadably connect to the cup. Other ways of connecting the fitting 50 to the cup are within the scope of the present disclosure. The circumferential wall 74 extends from the stationary plate 66 in the same direction as circumferential walls 56.

Figure 10:
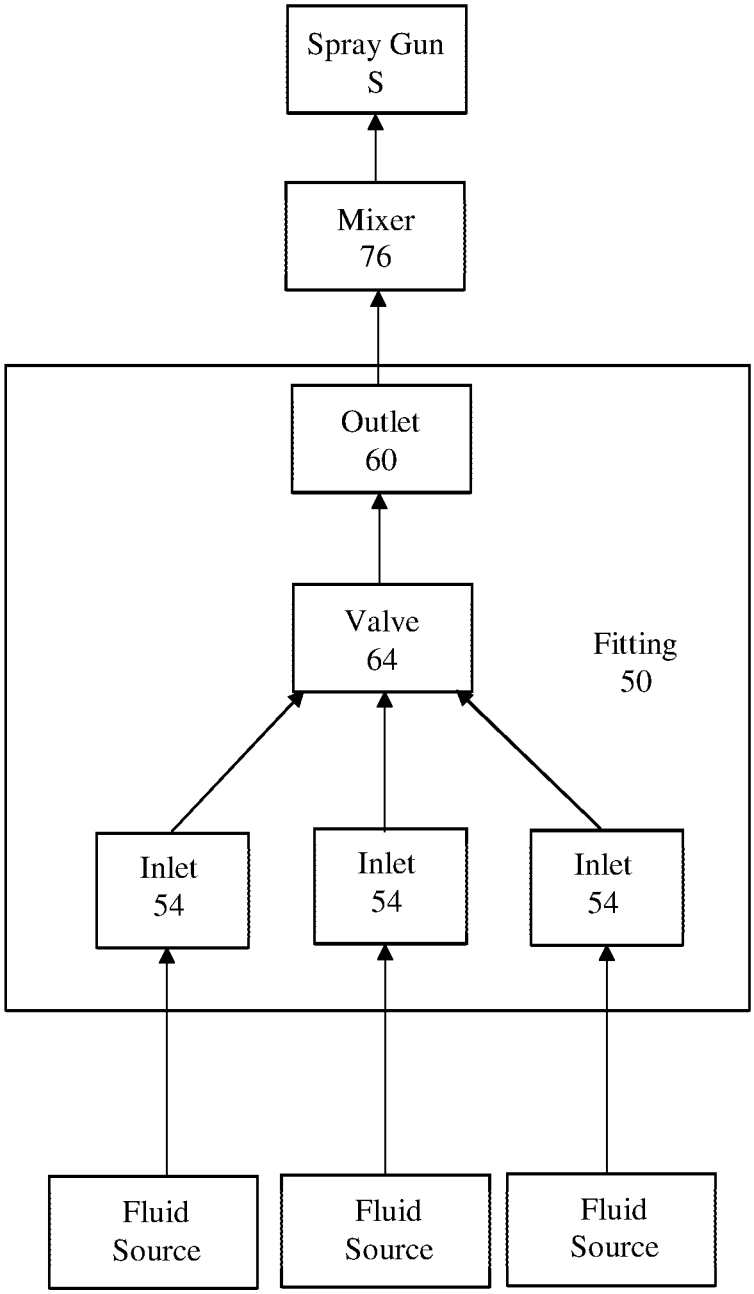
FIG. 10 is an exemplary schematic diagram of the flow of fluids from the fluid sources to the spray gun via the fitting.

Referring to FIGS. 5-10, in operation, the fluid contained in or supplied by each fluid source is drawn or fed out of each fluid source into the inlets 54, through the valve 64 and into the outlet 60 before entering the spray gun S. The fluids mix in the outlet 60 and continue to mix as the fluids (e.g., fluid mixture, fluid combination) move through and out of the spray gun S. In one embodiment, a mixer 76 (broadly, a mixing apparatus) may be connected to and between the outlet interface 58 and the spray gun S to mix the two or more fluids before the fluids enter the spray gun (FIG. 10). The mixer 76 may be any suitable device configured to mix or agitate a flow of fluid there-through, such as by introducing or creating turbulence in the flow of fluids. For example, the mixer 76 may include one or more protrusions, guides, and/or projections that extend into the flow and/or redirect the flow of the fluids to effectuate mixing. The mixer 76 may be disposable (e.g., configured to be used once and then thrown away). Similar to the valves 34, the one or more valves 64 and/or inlets 54 act as a proportional metering device, permitting a proportional amount of each fluid (relative to the amounts of the other fluids) to flow out of each fluid source in order to achieve the correct mixing ratio of the two or more fluids. For example, in the illustrated embodiment, the inlets 54 are generally equal in size (e.g., cross-sectional area taken relative to the direction of flow) resulting in generally equal proportions of each fluid flowing into the outlet 60 and into the spray gun S. Inlets 54 of generally unequal size would result in unequal proportions of each fluid flowing into the passageway. Accordingly, by controlling the size of the inlet 54 and/or valve 64 the fluid from each fluid source flows through, the relative proportions of each fluid dispensed by the spray gun S can be controlled. In this manner, the desired mixing ratio of the two or more fluids can be obtained. In addition, the one or more valves 64 can be partially opened (e.g., partially closed) to control the mixing ratio of the two or more fluids. For example, in an embodiment where each inlet interface 52 has a dedicated, independently operatable valve 64, the mixing ratio of the two or more fluids can be established by selectively determining the extent each valve is opened.

In one embodiment, the two or more fluid sources are two or more bags (not shown) that are supported by the cup used with the spray gun S. In this embodiment, each bag contains one of the fluids therein and each inlet interface 52 is configured to couple to one of the two or more bags. For example, each bag may have a bag outlet having threads so that the bag outlet can threadably connect to one of the inlet interfaces 52. In operation, the two or more bags are connected to the fitting 50 and positioned in the cup. The fitting 50 is then secured to the cup, using the cup connection portion 72. In this embodiment, the fitting 50 is a lid for the cup and secures the two or more bags in the interior of the cup. The outlet interface 50 is then used to connect the fitting 50 to the spray gun S. The bags may be bought pre-filled with fluid or empty and filled with fluid by the painter.

For example, each of the two or more bags can be pre-filled, by the manufacturer, with one of the two or more fluids. In this embodiment, each bag may include a tamper-evident seal or closure (not shown) to provide a visual indication to the painter if each bag, which has been pre-filled with fluid, has been accessed. The tamper-evident seal may close the bag or otherwise be operatively connected to the component closing the bag. For example, the tamper-evident seal may close the bag outlet or be operatively connected to (e.g., a part of) a component, such as a lid, that closes the bag outlet. In either case, the tamper-evident seal is configured to be at least one of deformed and/or removed (e.g., the tamper-evident seal is broken) in order to open the bag. In other words, the bags cannot be opened (e.g., accessed) without damaging the bag and/or the tamper-evident seal such that the bags cannot be reclosed and/or such that the bags having been opened is apparent. In this way, a painter can perform a quick visual inspection of each bag to check for any damage or signs that one or more of the bags have been accessed. Once the tamper-evident seal is broken by opening the bag (e.g., opening the bag outlet), the bag can be fluidly connected to the spray gun S, via the fitting 50, as described herein.

The fitting 50, as disclosed herein, keeps the separately contained two or more fluids from being mixed before being used in the painting process. This allows a painter to only use the amount of fluid required for a project, reducing material waste. In addition, the fitting 50 is able to open and close each inlet 54 via the valve 64. By keeping the fluids separate and having a valve 64 that can open and close (e.g., seal off) each inlet 54, the fitting 50 is able to reduce costs, time and waste. The cost savings is a result of having no substantial fluid waste. Any unused portion of a fluid (e.g., paint component) is retained in t is separate fluid source vessel so that it can be saved for later use.

In view of the above, it will be seen that several advantageous results are obtained.

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained. As various changes could be made in the above constructions and methods without departing from the scope of the invention, it is intended that all matter contained in the above description and shown in the accompanying drawings shall be interpreted as illustrative and not in a limiting sense.

The invention claimed is:

1. A cup liner for a cup of a spray gun, the cup supporting two or more fluids to be dispensed by the spray gun, the cup liner comprising:

a fluid reservoir portion configured to be received in an interior of the cup, the fluid reservoir portion configured to contain the two or more fluids, the fluid reservoir portion defining a reservoir configured to hold the two or more fluids, the fluid reservoir portion including a divider portion having one or more divider walls dividing the reservoir into two or more compartments, each compartment configured to contain one of the two or more fluids, the one or more divider walls separating each compartment such that each compartment is configured to separate the fluid contain therein from the fluids contained in the other compartments when the reservoir is filled with the two or more fluids, wherein the fluid reservoir portion is configured to be fluidly connected to the spray gun when the fluid reservoir portion is received in the cup such that the spray gun can draw at least a portion of each fluid from each of the two or more compartments to spray a mixture of the two or more fluids; and a fitting on the cup liner, the fitting comprising:

a lid wall portion configured to form a lid of a cup for the spray gun, the lid wall portion having an upper side and a lower side, the lid wall portion configured such that the upper side faces upward when the lid wall portion forms the lid of the cup and the cup is oriented so that the lid is at an upper end of the cup;

two or more inlet interfaces, each inlet interface configured for fluid communication with a respective one of the two or more fluid sources such that an individual stream of the fluid of each fluid source is passable through a respective one of the two or more inlet interfaces; and an outlet interface comprising an annular wall portion protruding directly from the upper side of the lid wall portion along an axis, the axis being transverse to the lid wall portion, the annular wall portion being generally centered on the lid wall portion, the annular wall portion including a lower end and an upper end spaced apart from the lower end along the axis, the lower end being conjoined to the lid wall portion such that the lid wall portion and the annular wall portion are in fixed relationship with one another, the annular wall portion defining an outlet chamber, the outlet interface configured to fluidly connect the outlet chamber with each inlet interface such that individual streams passing through the two or more fluid interfaces are combinable into a combined fluid stream in the outlet chamber, the outlet interface configured to be coupled to the spray gun, wherein the outlet interface is configured to provide fluid communication between the spray gun and the two or more fluid sources when the outlet interface is coupled to the spray gun and the two or more inlet interfaces are coupled to the two or more fluid sources such that the spray gun can draw at least a portion of each fluid from each of the two or more fluid sources to spray a mixture of the two or more fluids; and a valve, the valve being selectively adjustable between an open position and a closed position, the valve in the open position configured so that the individual fluid streams are passable from the two or more inlet interfaces through the valve to the outlet chamber, the valve in the closed configured to block fluid communication between the inlet interfaces and the outlet chamber.

2. The cup liner of claim 1, wherein the fluid reservoir portion includes at least three compartments.

3. The cup liner of claim 1, further comprising a liquid paint component in each of the two or more compartments.

4. The cup liner of claim 3, further comprising a tamper-evident seal that must be broken to access the liquid paint components in each of the two or more compartments without damaging the fluid reservoir portion of the liner.

5. The cup liner of claim 4, wherein the fluid reservoir portion includes a lower wall and a cylindrical outer wall extending upward from the lower wall, the lower and outer walls defining the reservoir, and wherein the one or more divider walls are connected to the lower and outer walls.

6. The cup liner of claim 5, wherein the outer wall has a longitudinal axis and the at least one divider wall includes three divider walls, the three divider walls all connected together along the longitudinal axis, the three divider walls dividing the reservoir into three compartments.

7. The cup liner of claim 1, in combination with at least one of the cup and the spray gun.

8. A fitting for a spray gun to connect the spray gun to two or more fluid sources, each fluid source having a fluid to be dispensed by the spray gun, the fitting comprising:

a lid wall portion configured to form a lid of a cup for the spray gun, the lid wall portion having an upper side and a lower side, the lid wall portion configured such that the upper side faces upward when the lid wall portion forms the lid of the cup and the cup is oriented so that the lid is at an upper end of the cup;

two or more inlet interfaces, each inlet interface configured for fluid communication with a respective one of the two or more fluid sources such that an individual stream of the fluid of each fluid source is passable through a respective one of the two or more inlet interfaces; and an outlet interface comprising an annular wall portion protruding directly from the upper side of the lid wall portion along an axis, the axis being transverse to the lid wall portion, the annular wall portion being generally centered on the lid wall portion, the annular wall portion including a lower end and an upper end spaced apart from the lower end along the axis, the lower end being conjoined to the lid wall portion such that the lid wall portion and the annular wall portion are in fixed relationship with one another, the annular wall portion defining an outlet chamber, the outlet interface configured to fluidly connect the outlet chamber with each inlet interface such that individual streams passing through the two or more fluid interfaces are combinable into a combined fluid stream in the outlet chamber, the outlet interface configured to be coupled to the spray gun, wherein the outlet interface is configured to provide fluid communication between the spray gun and the two or more fluid sources when the outlet interface is coupled to the spray gun and the two or more inlet interfaces are coupled to the two or more fluid sources such that the spray gun can draw at least a portion of each fluid from each of the two or more fluid sources to spray a mixture of the two or more fluids; and a valve, the valve being selectively adjustable between an open position and a closed position, the valve in the open position configured so that the individual fluid streams are passable from the two or more inlet interfaces through the valve to the outlet chamber, the valve in the closed configured to block fluid communication between the inlet interfaces and the outlet chamber.

9. The fitting as set forth in claim 8, wherein each of the inlet interfaces comprises a respective port through the lid wall portion.

10. The fitting as set forth in claim 9, wherein the ports are circumferentially spaced apart about the axis.

11. The fitting as set forth in claim 9, wherein each of the ports is spaced apart radially inboard of the annular wall portion with respect to the axis.

12. The fitting as set forth in claim 9 wherein each of the ports opens upwardly into the outlet chamber.

13. The fitting as set forth in claim 12, wherein the annular wall portion extends 360° about the outlet chamber with respect to the axis.

14. The fitting as set forth in claim 13, wherein the valve comprises a valve member connected to the annular wall portion for rotation with respect to the annular wall portion about the axis.

15. The fitting as set forth in claim 14, wherein the valve member comprises a plurality of valve member openings, the valve member being rotatable about the axis between an open position and a closed position.

16. The fitting as set forth in claim 15, wherein in the open position, the plurality of valve member openings are aligned with the ports such that the individual fluid streams are passable through the plurality of valve member openings and the ports to the outlet chamber.

17. The fitting as set forth in claim 16, wherein in the closed position the valve member blocks fluid communication between the outlet chamber and the ports.

18. The fitting as set forth in claim 8, further comprising a threaded collar for threadably connecting the fitting to a rim of the cup for the spray gun.

19. The fitting as set forth in claim 18, wherein the threaded collar is integrally formed with the lid wall portion.

20. The fitting as set forth in claim 18, wherein the threaded collar is configured to protrude from the lower side of the lid wall portion.

21. The fitting as set forth in claim 8, wherein the outlet interface is configured to begin mixing the fluid from each of the two or more fluid sources to initiate a chemical reaction between the fluid from the two or more fluid sources that causes a mixture of the two or more fluids to harden.

22. The fitting as set forth in claim 8, wherein the fitting is configured to attach to the spray gun for movement with the spray gun and wherein the fitting is configured to threadably attach to the cup for the spray gun for holding the two or more fluid sources in the cup on the spray gun.

23. The fitting as set forth in claim 8, wherein each of the two or more fluid sources is a bag and each inlet interface is configured to releasably couple to an individual one of the bags.

24. The fitting as set forth in claim 23, wherein each inlet interface comprises a bag connector protruding from the lower side of the lid wall portion.

25. The fitting as set forth in claim 8, wherein the annular wall portion is integrally formed with the lid wall portion.

26. The fitting as set forth in claim 25, wherein the fitting is free of flexible tubing between the lid wall portion and the annular wall portion.

27. The fitting as set forth in claim 26, wherein the annular wall portion and the lid wall portion are one piece.

* * * * *